US005383306A

United States Patent [19]

Michalon et al.

[11] Patent Number: 5,383,306

[45] Date of Patent: Jan. 24, 1995

[54] CLEANING APPARATUS FOR A CYLINDRICAL ROLL, AND IN PARTICULAR A MILL ROLL

[75] Inventors: Joseph Michalon, Chavillon/Salsigneux; Gérard Bertholon, Saint-Etienne, both of France

[73] Assignee: Clecim, Cergy-Pontoise, France

[21] Appl. No.: 2,504

[22] Filed: Jan. 6, 1993

[30] Foreign Application Priority Data

Jan. 6, 1992 [FR] France ..... 92 00045

[51] Int. Cl.[6] ..... B24B 5/37

[52] U.S. Cl. ..... 451/106; 451/424

[58] Field of Search ..... 51/161, 154, 251, 252, 51/289 R

[56] References Cited

U.S. PATENT DOCUMENTS

| | | | |
|---|---|---|---|
| 1,354,213 | 9/1920 | Rittberger . | |
| 2,627,708 | 2/1953 | Mater et al. | 51/289 R |
| 4,428,164 | 1/1984 | Dantinne | 51/252 |
| 4,619,080 | 10/1986 | Okamoto et al. | 51/161 |
| 4,841,675 | 6/1989 | Perneczky . | |

FOREIGN PATENT DOCUMENTS

| | | |
|---|---|---|
| 0154319 | 9/1985 | European Pat. Off. . |
| 1943847 | 3/1970 | Germany . |
| 3-149165 | 6/1991 | Japan . |

OTHER PUBLICATIONS

"Roll Polishing Device"-Patent Abstracts of Japan Jun. 1991.

"On-Line Grinding Device for Rolling Mill" Abstracts of Japan Jan. 1989.

*Primary Examiner*—Robert A. Rose

*Attorney, Agent, or Firm*—Pollock, Vande Sande & Priddy

[57] ABSTRACT

Cleaning apparatus for a roll placed in contact with a metal strap moving longitudinally in an installation comprising a set of rotary-mounted superposed rolls between two stands of a fixed supporting cage and comprising at least one wiping tool (4) parallel to the axes of the rolls, a device (3) supporting the wiping tool mounted slidingly on straight guide rollers (24, 24') provided on a cradle (2) pivotably mounted on both stands (11) of the cage (1) around a pivot axis (20) parallel to the axes of the rolls. The cradle (2) comprises two spaced parallel flanges (21) linked rigidly by a cross-beam (22) and rotatably mounted, respectively, on two bearings fixed, respectively, on both stands (11) of the cage (10) and placed so that the cradle (2) can pivot between a working position in which the sliding plane of the supporting device (3) is oriented to the roll (1) to be cleaned and a maintenance position in which the sliding plane is removed from the roll (1) and the supporting device (3) is placed along both stands (11) of the cage (10), slightly extending in from the roll (1) and is placed along both stands (11) outside the cage, the supporting device extending in cantilever, in forward position, beyond the guide rollers (24, 24') to its front section (36) carrying the wiping tool (4) is located close to the roll (1) and the front section (36) is brought back of the cradle (2) in the rearward position of the frame (3) to allow the cradle (2) to pivot to the maintenance position along the stands (11) of the cage.

25 Claims, 6 Drawing Sheets

CLEANING APPARATUS FOR A CYLINDRICAL ROLL, AND IN PARTICULAR A MILL ROLL

FIELD OF THE INVENTION

The present invention relates to cleaning and/or polishing apparatus for a roll placed in contact with a metal strap moving in a longitudinal direction, and more especially to the cleaning and wiping of the working rolls of a sheet metal mill and, especially, a skin-pass mill. However, the invention may find an application in other installations comprising a set of rolls with parallel axes superposed inside a cage and over which a strap-like product passes, especially when only limited is space available for the cleaning apparatus and it must function without interfering with the passage of the product.

BACKGROUND OF THE INVENTION

During the various transformation phases occurring in the elaboration of a strap-like product, and especially a metal sheet, it is often contemplated to wind the strap into a reel, for instance to maneuver, store or move it more easily.

To perform some kind of processing on the strap, such as rolling or surface coating, cleaning, etc., it must be unwound and transferred using a series of backing and driving rolls. During this process, the strap winds around the various rolls on a contact sector, and metal particles or various contaminants may get stuck on the surfaces of these rolls.

These particles have a tendency to build up and get encrusted on the rolls, leaving marks on the rolls as well as the strap. Damage caused by such particles have serious consequences. For instance, in the metal industry, during rolling, many particles from the sheet unavoidably get stuck on the working rolls or the backing rolls, causing deterioration of the surfaces of the rolls and periodic marking of the strap. Reels may be rejected because of surface imperfections. It is then necessary to change the rolls to have them remachined much more often than required under normal wear. This is very costly, especially when rolls coated with a rubber layer or any other metal or organic coating are used.

It has therefore been attempted to clean the rolls during operation in order to remove the particles or other contaminants before contact with the strap and avoid their incrustation.

At the outset, this cleaning was performed manually but, taking the space requirements of the installation and the passage speed of the strap into account, this operation was relatively dangerous and, in any case, did not produce a satisfactory result.

Thus it was suggested to wipe, clean ore polish the rolls without any manual intervention, using devices enabling the roller to be contacted directly by a cleaning tool such as a rotary brush or a scraping device.

JP 3-149.165, for instance, shows such an apparatus, designed to perform the polishing of one of several rolls associated with parallel axes. This apparatus comprises two rotary grinding wheels mounted on a first movable carriage, parallel to the axes of the rolls, on a second carriage itself slidingly mounted on two straight guiding devices apart from one another, and defining a sliding plane of the grinding wheels parallel to the axes of the rolls and adapted to be directed toward either axis thereof by pivoting of the guiding devices around an axis which is adjustable in height. It thus becomes impossible to direct the sliding plane radially towards the axis of the roll to be polished by adjusting the height of the axis and the orientation of the guiding means, then to locate the grinding wheels in contact with the roll by causing the second carriage to slide.

It could be contemplated to replace the grinding wheels with rotary brushes, but such an apparatus is relatively encumbering and not readily applicable to the mills in which the space requirements are often quite restricted, between the rolled strap and the rolls, to place the cleaning apparatus. The cleaning apparatus must allow introduction into this restricted area until it contacts the rolls to be cleaned and, periodically placed in a position enabling maintenance or replacement of the cleaning tool, preferably without stopping the passage of the rolled strap.

DE-A-1.943.847, which applies to the maintenance of the working rolls of a Quarto-type mill, shows an apparatus comprising rotary brushes carried, at their ends, by two supports which can be moved parallel to themselves in order to contact the working roll to be cleaned or to move apart to a remote position. However, even in this position, the brushes are still close enough to cult to disassemble them.

Besides, in the case of sheet metal rolling mill installations, it is sometimes preferred to use, for cleaning the rolls, a wiping tool in the form of a stripping ruler parallel to the roll axis and made of a stone or a resin associated with an abrasive, which can be applied to the roll by means bearing on a supporting device, for instance pneumatic or hydraulic cylinders.

U.S. Pat. No. 4,841,675 shows an apparatus in which the cleaning tool is made of several stones located one behind another and carried by a stem parallel to the longitudinal axis of the roll. Every stone is applied elastically on the roll by an arm attached to the stem via an elastic bush which allows the stone to suit the profile of the roll. The supporting stem can be moved alternately in an axial direction in order to homogenize the cleaning operation. The assembly is placed on a chassis attached on the cage at the level of the roll to be cleaned and that can be moved horizontally in order to apply the cleaning tools on the roll or move them apart to enable dismantling.

Such a device is relatively encumbering and therefore, in the case of U.S. Pat. No. 4,841,675, it is applied to the cleaning of the backing rolls of the mill. Conversely, it could hardly be used for cleaning the working rolls since the cleaning tools must move within a very narrow area, restricted on one side by the backing roll and, on the other, by the passing strap. Besides, the mills are often fitted with somewhat encumbering ancillary devices, located close to the strap. Especially the skin-pass type mills are associated with antipleating rolls or others, themselves mounted on adjustment devices diminishing further the area available to access the working rolls.

Besides, dismantling all the stones takes a long time and requires extended shut-down of the line.

Moreover, the stones are attached independently on the supporting stem, each via an arm linked to the stem by an elastic ring, and it is difficult enough to adjust the backing pressure of the stones uniformly over the entire length of the roll.

Finally, the system possesses a larger cantilever which reduces the quality of the cleaning and may cause vibrations, especially if it is necessary to reduce the size of the supporting chassis in order to limit the encumbrance.

Therefore, in the case of rolling mills, it is often preferable to eliminate the wiping tool and to perform the cleaning by simple detergent projections, but these are powerless against incrustation of solid particles and require working in a humid environment.

SUMMARY OF THE INVENTION

The invention is intended to solve all the foregoing problems and relates to a relatively little encumbering cleaning apparatus so that, even if the area of access to the roll to be cleaned is rather limited, especially in the case of a rolling mill, it is possible to find a position enabling the introduction of a wiping tool into the space to bring in contact of the roll, and to bring it back to a maintenance position, sufficiently apart from the rolls and from the strap to allow removal and replacement of the tool without stopping the operation and, especially, the passage of the strap.

The apparatus also eliminates vibrations and thus improves the quality of cleaning and reduces the risk of markings on the roll to be cleaned.

The invention thus relates to a cleaning and polishing apparatus for a roll in contact with a metal strap moving in a longitudinal direction, in an installation comprising a set of superposed rolls with parallel axes, rotatably mounted, each on two bearings carried by two vertical stands on a fixed supporting cage located on both sides of the rolls. The apparatus comprises;

at least one wiping tool extending parallel to the axes of the rolls:

a device for supporting the wiping tool, slidingly mounted on straight guiding means defining an average sliding plane of the supporting device parallel to the axes of the rolls;

a cradle, mounted on both stands of the cage for pivoting movement around an axis parallel to the axes of the rolls, the cradle being constituted by two spaced parallel flanges linked rigidly by a cross-beam;

each flange comprising two sections extending on both sides of the cross beam, respectively an external widened section oriented toward the strap and on which the corresponding straight guiding means has been arranged, and an internal section, oriented toward the cage, on which a journal defining the pivoting axis is fixed;

the journals being rotatably mounted on two fixed bearings, respectively, on both stands of the cage and located so that the cradle may pivot between a working position in which the sliding plane of the supporting device is oriented toward the roll to be cleaned and a maintenance position for which the sliding plane is moved away from the roll and the supporting device is placed along both stands of the cage, slightly outside the cage;

control means for sliding the supporting device on the cradle between a forward application position of the tool on the roll and a retracted position, and vice versa;

control means for pivoting of the cradle around the axis, between the maintenance position and the working position, and vice versa;

the supporting device consists of a rigid rectangular frame, covering, in the longitudinal direction, a length greater than that of the sliding guiding means so that, in the working position of the cradle, the frame may extend in cantilever fashion, in its forward position, beyond the guiding means until its front section carrying the wiping tool is located close to the roll and the front section is brought back to the level of the cradle in the rearward position of the frame in order to allow the cradle to pivot to the maintenance position along the stands of the cage.

As the front section of the supporting cage comes as close as possible to the roll to be cleaned, preferably the wiping tool is mounted for movement, parallel to itself on the front section via an articulated control system in one direction, forward motion of the tool outside the supporting device for its application on the roll and, in the other direction, retraction of the tool.

Advantageously, the articulated control system for application of the wiping tool comprises at least two articulated arms, on one end, on the free end of the supporting device, around an axis parallel to the roll axes, and carrying the wiping tool toward their other end, and at least one control means for the rotation of these arms around the axis, respectively for the application and for the retraction of the tool.

Generally, the supporting device consists of a metal rectangular frame, delimited by two longitudinal sides, perpendicular to the roll axis and of sufficient thickness to ensure the stiffness of the frame as well as reduced thickness to enable the frame to slide until the roll without interfering with the rolls and the various ancillary devices of the installation.

Preferably, the control system for the application of the tool will be such that, in the retracted position of the tool, the entire tool and its means of application are completely folded back inside the supporting device.

The frame sliding guiding means must cover sufficient length to ensure the cantilever position of the frame when extended.

According to a preferred embodiment, both longitudinal sides of the supporting frame of the tool are made up of a guiding girder, sliding on at least two spaced rollers, rotatably mounted on each flange of the cradle and bearing in opposite directions on the corresponding girder for maintaining the frame according to a sliding direction. Each guiding girder advantageously comprises two parallel wings between which the rollers engage, the rollers having a diameter substantially equal to the spacing of the wings, with normal clearance.

The movable frame can be associated with a first pair of locking cylinders, each mounted on a projecting part fixed on the corresponding sides of the cradle between the rollers, and ensuring the application of the guiding girders on the rollers.

To reduce the risk of vibrations, the front section of the movable frame is preferably removably linked to the supporting cage, using a pair of locking jacks located on both sides of the movable frame and each mounted on a supporting part attached on the corresponding stand of the cage in the area occupied by the front end of the movable frame when it is in forward position and extending and projecting from the stand, so that it would be then in the way of the corresponding side of the stand, whereas each jack located on the projecting part engages, when the frame is sliding, between two spaced parts of the side and bearing in opposite directions on the spaced parts in order to lock the movable frame in its forward position.

In the case where both longitudinal sides of the movable frame have a U-shaped profile with two parallel wings, the projecting supporting parts of the blocking cylinders engage respectively between both wings of the corresponding profile, whereas each projecting part and the associated jack bear in opposite directions on both wings of the girder in order to lock the movable frame in position.

According to another preferred embodiment, the wiping tool is carried by at least a supporting part, slidingly mounted on a stem parallel to the roll axis between two positions which are offset longitudinally, whereas the movable frame is fitted with alternate control means of the sliding of the supporting part with the tool with the offset positions, so that the tool covers at least the entire length of the roll.

The wiping tool can advantageously be carried by at least one supporting part fixed on a sleeve engaged on a rod parallel to the axis of the roll and attached between both sides of the frame, the sleeve extending over a length shorter than the roll by a distance d and attached at each end on a plate bearing on the corresponding side of the supporting frame by a sliding link enabling alternate displacement of the sleeve over the distance d.

The wiping tool may consist either of a single piece covering substantially the entire length of the roll, or of several parts located one after the other in order to cover substantially the entire length of the roll and each being carried by a supporting part.

According to another advantageous characteristic of the invention, the wiping tool consists of a contact part in the form of a relatively hard ruler, fixed over its entire length on an elongated part made of relatively flexible material and engaged in a hollow and rigid profile via which the set is fixed on the supporting part of the tool.

In order to facilitate the separation of the particles, fluid can be injected along the contact surface of the wiping tool, which is drilled to this end with a plurality of bores, distributed over its entire length and leading, on one side to the contact surface with the roll and on the other, to a manifold fed with pressurized fluid.

It is desirable to collect the particles and other contaminants separated from the roll in order to prevent them from falling on the strap or other parts of the installation. To do so, the wiping tool can be fitted, on its surface contact with the roll, with at least one longitudinal groove extending over the entire length of the tool and inside which the separate particles build up. Preferably, this groove is tilted with respect to the horizontal plane, at least toward one extremity of the roll, in order to evacuate the collected particles.

The wiping tool may be associated with a flexible blade covering the entire length of the tool, at some distance from the tool and upstream in the rotation direction of the roll and abutting against the latter in order to retain the particles separated from the roll by the tool.

According to the invention, the apparatus is especially suited for cleaning the working cylinders of a rolling mill, particularly of the skin-pass type, consisting of at least one working roll interposed between at least two backing rolls. In such a case, the rotary cradle on which the tool supporting sliding frame is mounted is sized and its pivoting axis is positioned so that in the maintenance position, the front section of the frame supporting the tool is situated substantially at the center part of the backing roll corresponding to the working roll to be cleaned.

Thus, the tool is easily accessible for maintenance or replacement purposes.

Moreover, in the working position, the cradle is placed so that, in forward position, the surface of the supporting frame of the tool oriented toward the backing roll associated with the working roll to be cleaned, passes close to the surface of the roll.

BRIEF DESCRIPTION OF THE DRAWINGS

Several embodiments of the invention will now be described with reference to the accompanying drawings.

DESCRIPTION OF PREFERRED EMBODIMENTS

Figure 1:
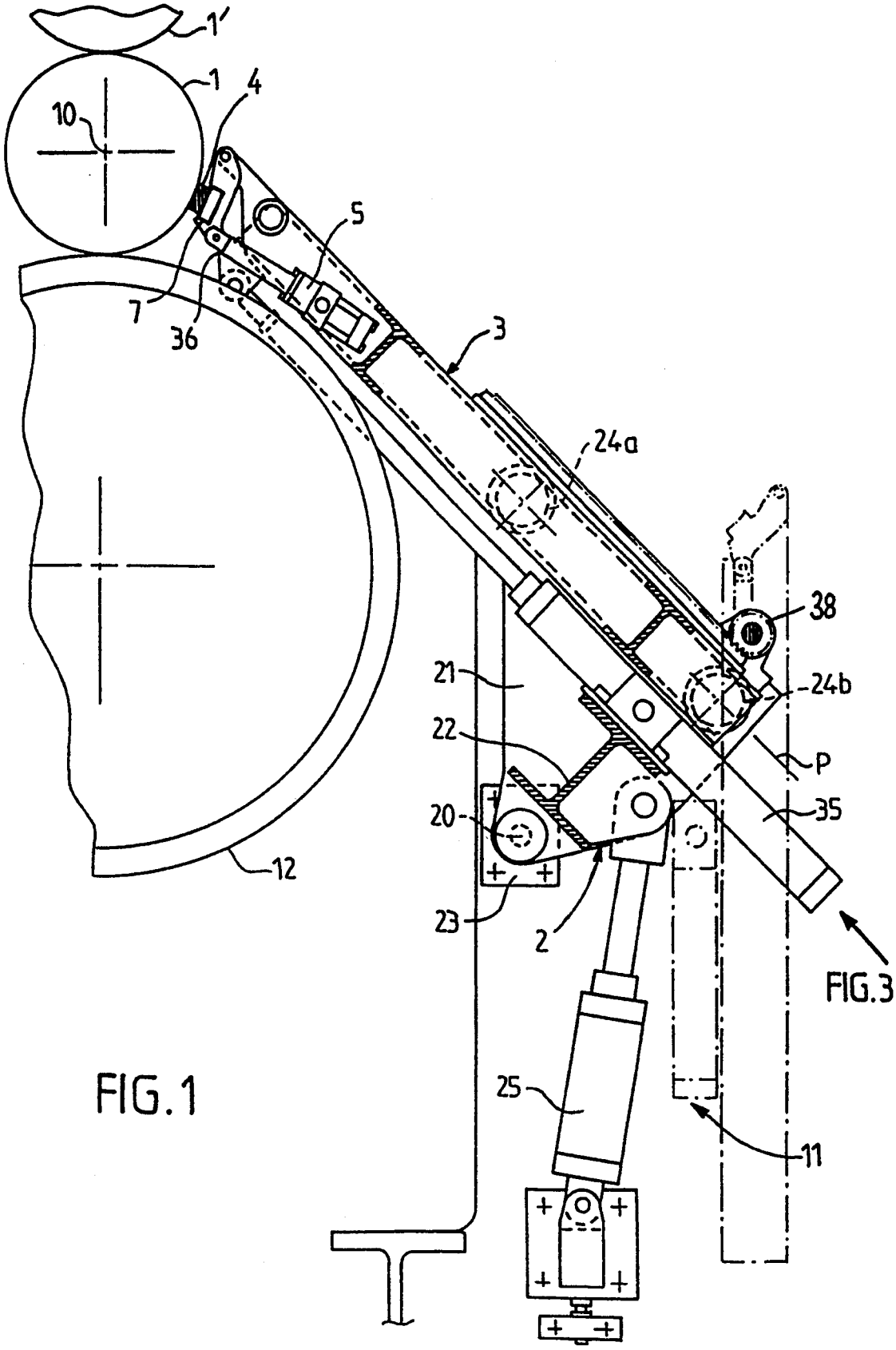
FIG. 1 is a side view, partly in section, of the cleaning apparatus according to the invention.

FIG. 1 shows a roll mill according to the invention, comprising two working rolls 1, 1', between which a metal strap A is rolled. The working rolls are associated with backing rolls 12, and are each supported by two vertically slidingly-mounted chocks on stands 11 of the roll mill cage.

The cleaning device comprises a pivoting cradle 2 on which a mobile frame 3 is slidingly mounted, extending and projecting from the cradle 2 and carrying, on its front end 36 directed toward the roll 1, a wiping tool 4 associated with application means 5 supported on the frame.

Figure 2:
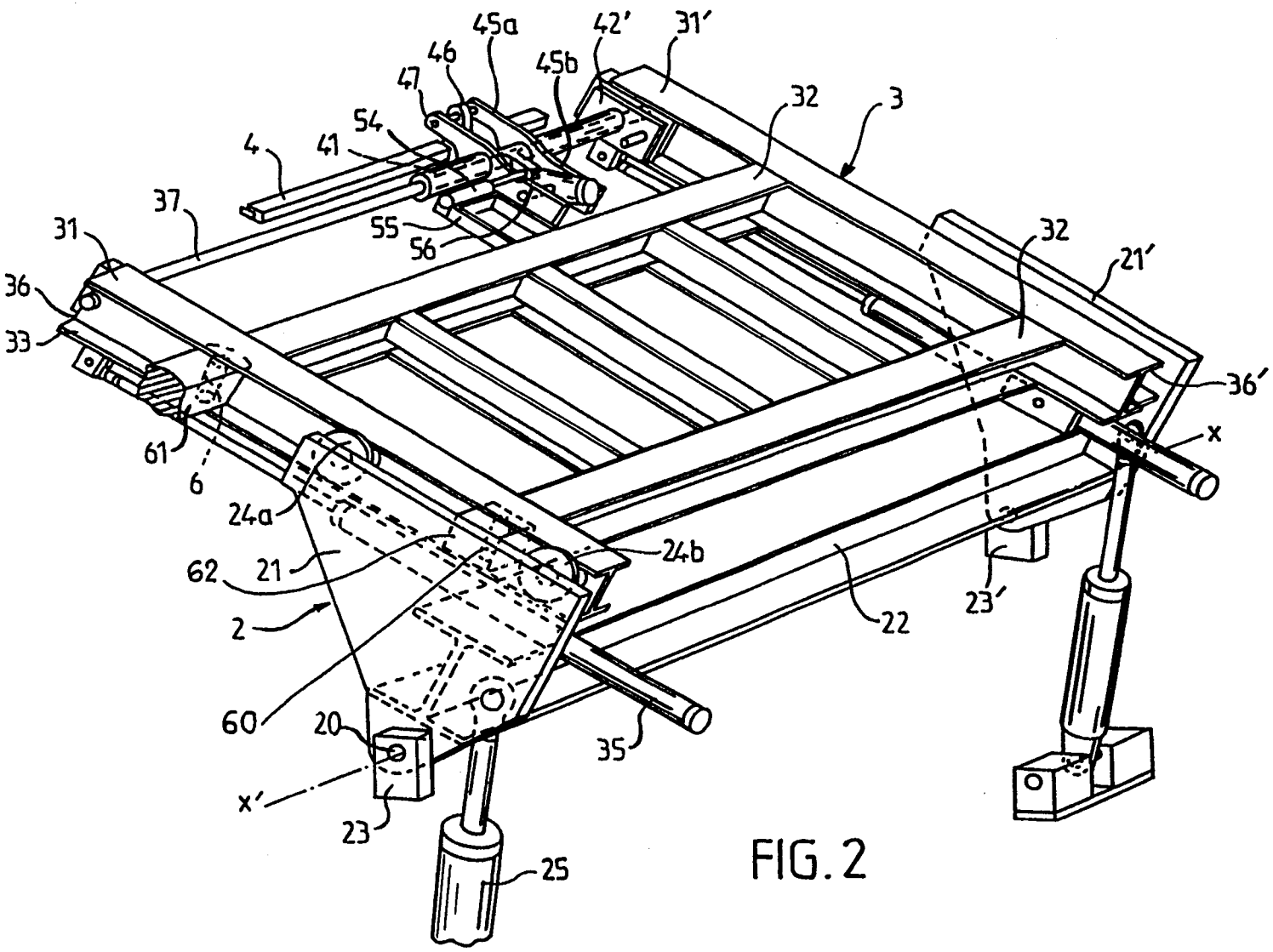
FIG. 2 is a schematic perspective view.
Figure 3:
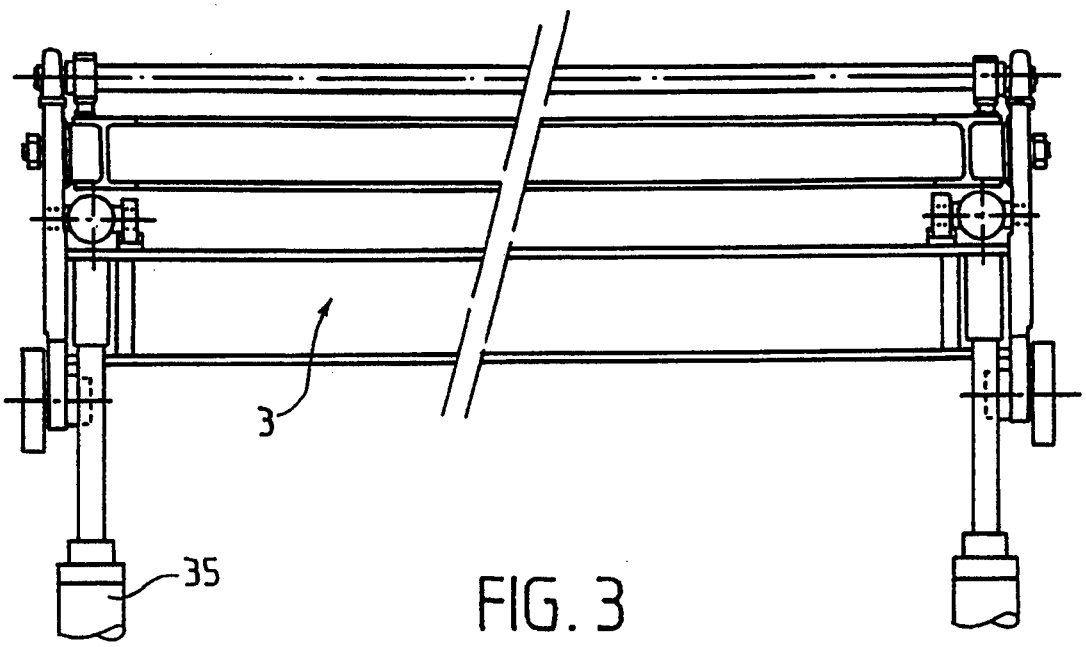
FIG. 3 is a rear view in the direction of arrow F of FIG. 1.

The entire apparatus is shown schematically and in perspective in FIG. 2.

As shown, pivoting cradle 2 comprises two flanges 21, 21' rigidly connected by a cross beam 22 and articulated respectively on two aligned bearings 23, 23' defining a tilting axis 20 parallel to the roll axis 1 and carried respectively by the two stands 11 of the cage of the rolling mill. The spacing of the two flanges 21, 21' is somewhat greater than the length of the active section of the rolls 1, 12.

Both flanges 21, 21' have a substantially trapezoidal shape comprising a center part **21*a* for fastening the cross beam 22 and, on both sides thereof, an external section forming a widened base 21*c* carrying the sliding guiding :means of the frame 3 and a spike internal section 21*d* carrying a journal defining the tilting axis 20 and rotating in the bearing 23** fixed on the corresponding stand of the cage.

The widened base 21*c* is oriented toward the strap A to be milled, while the articulation spike is oriented toward the backing roll 12 associated with the roll 1 to be cleaned, so that the tilting axis 20 is located on the internal side of the stand 11 of the cage close to the internal surface 11*b* oriented toward the guiding window, and substantially at the lower part of the backing roll 12. The distance between the tilting axis 20 and the guiding means 24 is substantially equal to the width of the stand 11, so that, when the cradle is in the maintenance position represented in dash-dot lines on FIG. 1, the guiding means 24 and the frame 3 are located along the external surface of the stand 11, slightly outside it.

The guiding means of the frame 3 comprise, for each flange 21, 21', a pair of spaced rollers 24*a*, 24*b*, mounted on the flange 21 for rotation around axes parallel to the tilting axis 20 and, two profiles constituted by girders 31, 31', rigidly connected by cross beams 32. Each girder 31, 31' has a U- or I-shape with two parallel wings 33 whose spacing is substantially equal, with clearance, to the diameter of the rollers 24*a*, 24*b*. Thus, as shown in FIG. 2, the frame 3 can be inserted between the two flanges 21, 21' of the cradle 2 as a drawer. The rollers 24*a*, 24*b*, 24'*a*, 24'*b*, whose axes are situated in a same plane P parallel to the tilting axis 20, engage between the parallel wings 33 of the corresponding girder 31 and abut against these wings in order to maintain the frame 3, which thus can slide along the plane P under the action of one or two cylinders 35 whose body and stem are articulated, around axes parallel to the tilting axis 20, respectively on the cradle 2 and on a device located on the front end 36 of the frame 3 oriented toward the roll 1.

Preferably, synchronism of the translation is ensured by two pinions 38 mounted on a same shaft and respectively engaging racks arranged along the two girders 31, 31'.

The tilting of the cradle 2 with the frame 3 around the 20 axis 20 is controlled by one or two synchronized cylinders 25 whose body and stem are articulated, respectively, on the fixed chassis 11 and on the cradle 2 around axes parallel to the tilting axis 20.

Thus, the cradle 2 can take two positions, a working position represented in solid lines in FIG. 1 and a maintenance position represented in dash-dot lines.

The lengths of the profiles 31, 31' are determined so that, in extended y, of by the base 21*c* of the flanges 21, 21'.

The width of the frame 3 and the spacing of the cylinders 35 are greater than the length of the active section of the backing roll 12, so that in the extended position of the frame 3, the stems of the two cylinders 35 can stretch on both sides of the active section of the roll 12. Thus, the cradle 2, in working position, can be so oriented that the internal surface of the frame 3 oriented toward the roll 12 comes as close as possible to this roll without any risk of deterioration.

The cleaning tool 4, constituted by a ruler parallel to the roll 1, is mounted at the front end 36 of the frame 3 via an articulated system revolving around an axle 47 located at the end of the frame 3, as close as possible to the roll 1, so that, while revolving around the axle 47, the tool 4 abuts substantially perpendicularly against the periphery of the roll 1. The articulated control system 5 for application of the tool 4, which will be described in detail hereinbelow, is extended forwardly so that it can be folded back completely within the thickness of the frame 3. This thickness must be simply sufficient to ensure the stiffness of the frame 3 in extended position, taking into account the cantilever and the space between the rollers 24*a*, 24*b*, but it can be restricted enough so that the frame 3, with the tool 4 and its application system, may come very close to the roll 1 while passing between the devices associated with the roll mill, without interfering with these devices.

When the tool 4 is removed from the rolls for maintenance or replacement, the frame 3 is first slid to its retracted position in which its front end 36 comes to the level of the upper part of the base of the flanges 21, 21'. The whole assembly is then tilted, using the cylinders 25, to the maintenance position represented in dash-dot lines in FIG. 1.

Figure 6:
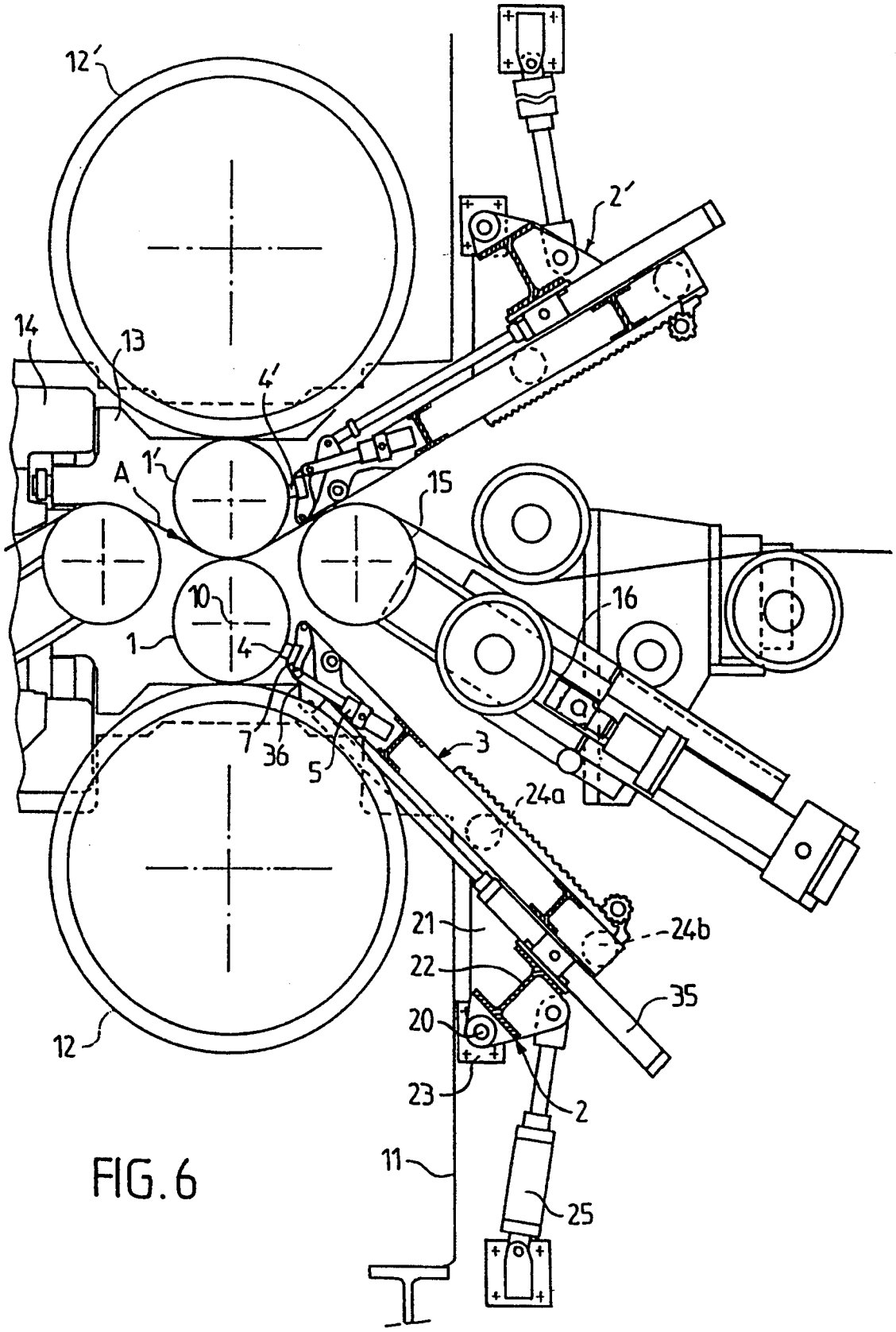
FIG. 6 is an overview of a "skin-pass" type roll mill fitted with two cleaning devices.

Due to the offset to the inside of the tilting axis 20 with respect to the base 21*c*, the maximum space requirements of the device are determined, on one side of the strap A, by an arc of a circle C centered on the axis 20 and which immediately separates from the strap because the axis 20 is located more or less vertically at the upper end of the base 21*c* of the cradle 2 in working position. As can be seen in FIG. 6, the front section 36 of the frame 3 can thus revolve around the axis 20 without interfering with the rolling mill and its ancillary devices, even when they are relatively large, as in the case of antipleating roll adjustment devices.

At the end of the tilting motion, the frame 3 is positioned vertically along the external surface of the stands 11 of the cage and projects only a little outside the cage, while its front section 36 carrying the tool 4 is located substantially at the level of the central part of the backing roll 12. In this position, the tool 4 is readily accessible for maintenance, disassembly and replacement.

The system 5 for support and application of the tool 4, which is designed, as indicated above, to fold back completely inside the thickness of the frame 3 when it is in motion, will now be described more in detail with reference to FIGS. 4 and 5.

Between the front ends 36 of the two lateral girders 31,31' of the frame 2 stretches a cylindrical shaft 37 parallel to the tilting axis 20, on which is mounted a tube 41 whose length is less than that of the shaft 37 by a distance (a) and which forms a sheath that may slide to-and-fro over the distance (a) along the shaft 37.

At each end of the tube 41, a plate 42 (42') is attached, fitted with a hole defined, for instance, by a socket 43 and into which a short shaft 44 (44') can be inserted, attached on the corresponding girder 31 (31') and extending to the inside of the frame 3 in parallel to the shaft 37.

Both short shafts 44, 44', have a length slightly greater than the difference (a) between the length of the tube 41 and that of the shaft 37, in order to enable the to-and-fro motion of the tube 41 while maintaining the orientation of the plates 42, 42', and, consequently, of the tube which thus can slide without revolving around the shaft 37.

Figure 4:
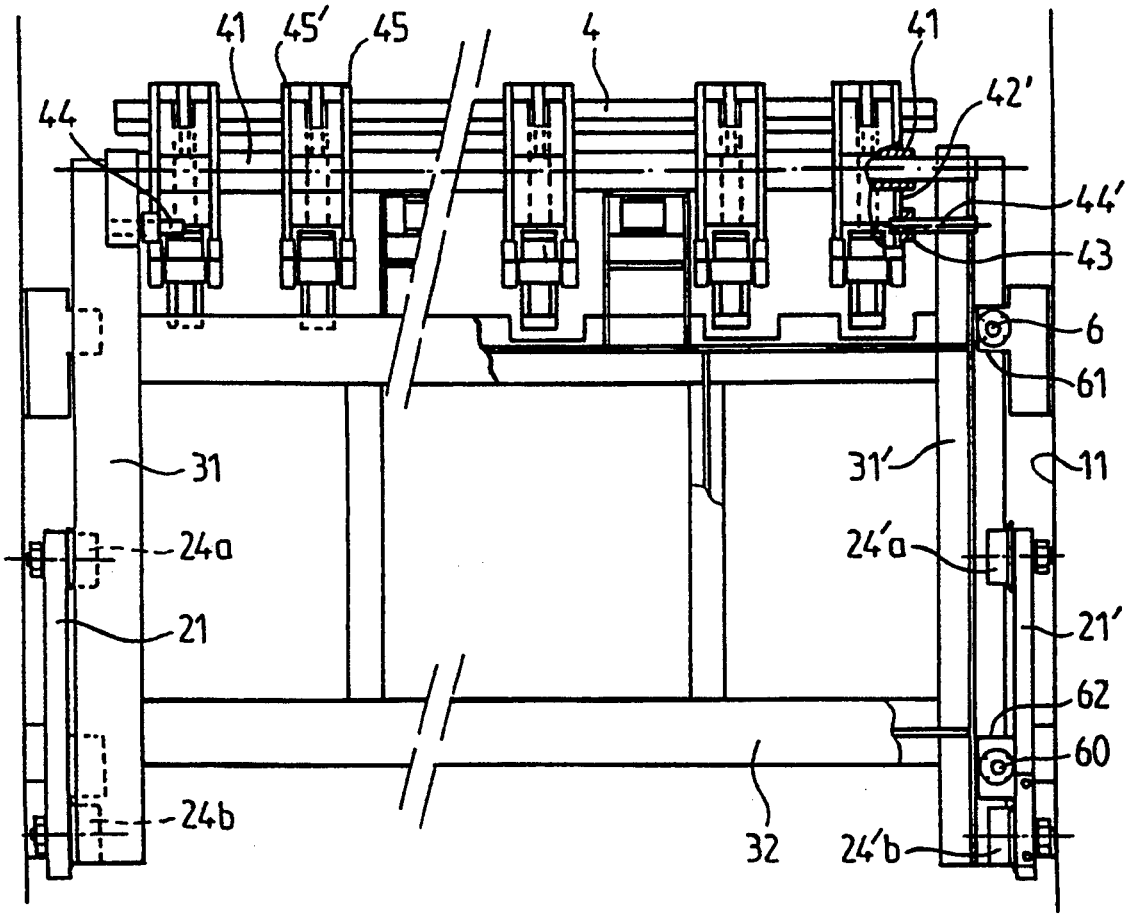
FIG. 4 is a top plan view of the movable frame.

As can be seen on FIG. 4, several retaining clevices 45 are scattered over the entire length of 10 the tube 41, each made up of two flat surfaces 45. 45', spaced from one another and welded on the tube 41 perpendicularly thereto. i.e., parallel to the girders 31, 31'.

Each flat surface 45, 45' comprises two arms extending on both sides of the tube 41, respectively an external arm 45*a* and an internal arm 45*b*.

The wiping tool 4 has the general shape of a ruler covering a length slightly greater than that of the tube 41, parallel to this tube, and connected to the retaining clevices 45 by several suspension elements 46, each in the form of an arm articulated around an axis 47 at the end of the two external arms 45*a* of the clevice 45.

A jack 51 is located between the two internal arms 45*b* of each retaining device 45. Its body is articulated on the arms 45*b* around an axis 52, and its articulated around an axle 53 on the arm 46 for the suspension of the tool 4, at its end opposite the rotation axle 47.

It is possible to suspend the tool 4 by only two retaining clevices 45, but the use of three or more devices distributed over the entire length of the tube 41 and each associated with a jack 51 renders the application effort of the wiping tool 4 on the roll 1 more homogeneous over its entire length.

Tube 41, which slides on the supporting shaft 37 is moved to-and-fro by means of a jack 54 along an axis parallel to tilting axis 20 and bearing on one side against the frame 3 and on the other on the tube 41.

Jack 54 is mounted on a support 55 attached to a spacer 32 of the frame and the tube 41 carries nippers 56 on the rod end of the jack 54.

Figure 5:
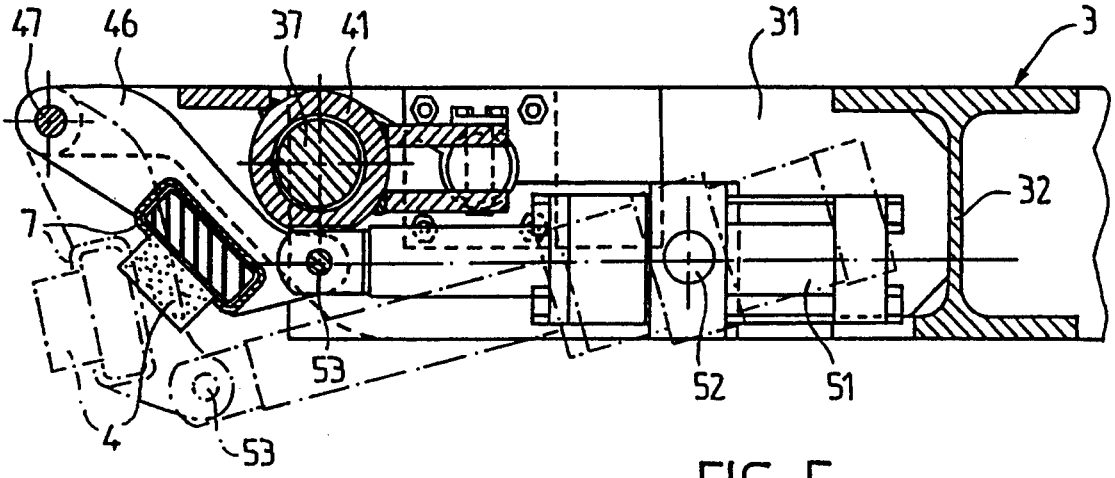
FIG. 5 is a detail view of the means for applying the tool.

As can be seen in FIG. 5, when the tool 4 is in its retracted position, shown in solid lines, the whole articulated system 5 is completely folded back into the thickness of the frame 3 which is just sufficient to impart the necessary rigidity to the frame, taking the cantilever into account. The effect of the cantilever can be restricted by abutment against the stands 11 of the front section 36 of the frame.

Due to these provisions, the frame 3 including the tool application system is of minimal thickness and, by tilting the cradle 2 into working position and translation of the frame 3, the frame can move forward, between the strap and the various devices of the roll mill until the articulation axle 47 of the arms 46, located at its front end, is as close as possible to the active surface of the working roll to be cleaned, without any risk of deterioration of the active surface.

The rotation center of the arms 46 being thus located as close as possible to the toll 4 is applied to the active surface of the roll 1, the tool 4 is applied to the active surface of the roll 1 in a substantially perpendicular direction. The arms 46 are relatively short. Thus, the risks of vibration and chattering of the tool 4 in contact with the roll 1 are reduced, and the relative positions of the axle 47 and of the tool 4 with respect to the roll can be determined so as to adjust the application angle of the tool on the cylindrical surface in order to reduce the chattering risks further.

The length of the arms 46 and the positioning of the articulation axles 52, 53 can be such that, in application position of the tool, the mechanism can be fitted in the dihedral defined by the cylindrical surfaces of the working roll 1 and of the backing roll 12 in order not to interfere with the backing roll.

As indicated, to reduce the effect of the cantilever in working position and consequently to reduce the space requirements of the frame, the front end of the frame 3 can advantageously be locked in its extended position with respect to both stands 11 of the cage. To this end, two locking jacks 6 are mounted respectively in supporting pieces 61 attached to and projecting from the stand 11 of the cage, the piece 61 being so placed that it will be in the way of the corresponding girder 31 (31') of the frame 3 when the frame slides, while rolling over the rollers 24, up to its extended position. Each projecting piece 61 is oriented according to the sliding plane P and has a thickness substantially equal to the diameter of the rollers inserted between the two wings 33 of the corresponding girder 31. Conversely, the frame 3 is released from the supporting pieces 61 when retracted onto the cradle 2.

The upper section of the projecting pieces 61 is rounded in order to facilitate engagement of girders 31, 31'.

This way, in working position, the front sections 36 of both girders 31, 31' can abut against projecting pieces 61 and be locked by the jacks 6, thus preventing any vibrations.

The rear section 36' of the frame 3, which remains engaged in the guiding means 24, 24', can also be bound to the cradle 2 by means of jacks 60 each accommodated in projecting pieces 62 attached on a flange 21 of the cradle 2 which toggles between the rollers 24*a*, 24*b* and engages between the two wings 33 of the corresponding girder 31 (31'). The jacks 60 enable the girders 31, 31' to be applied vigorously in one direction to the corresponding rollers and, thus, to prevent vibrations.

In this way, in the forward application position of the tool 4, the supporting frame 3 is perfectly blocked at its front section 36 with respect to the stands 11 and at its rear section, with respect to the cradle 2, itself rigidified by the cross beam 22.

Due to the blockage of frame 3 and to the particular arrangement of the support and application mechanism of the tool 4, the entire wiping system is extremely rigid in working position, making it possible to reduce, and practically to eliminate, the vibration phenomena detrimental to thorough cleaning of the roll.

The wiping tool is preferably constituted by a single piece which promotes homogeneous contact over the entire length of the roll, and can be changed easily and in one operation, thanks to the provisions according to the invention which enable the tool to be released as soon as necessary from the machine center, then to toggle the cradle, movable frame and wiping tool assembly to the maintenance position in which the tool is readily accessible to the operator. This operation can be performed very quickly and does not require installation shut-down.

In practice, very good quality continuous wiping can be obtained and the speed of change is such that, for instance, in continuous rolling, the time required for replacement of the tool does not affect the quality of the rolling.

Indeed, the invention is especially suited to the wiping of a "skin-pass" type rolling mill provisions represented on FIG. 6, which shows schematically, a mill cage comprising two working rolls 1, 1', surrounded by two backing rolls 12, 12', the four rolls being supported in a cage only one stand 11 of which is illustrated.

It is known that a "skin-pass" type mill cage comprises a very large number of ancillary devices with variable space requirements. For instance, the working rolls 1, 1' are supported at their ends by chocks 13, slidingly mounted in hydraulic blocks 14 attached to the stands 11 of the cage. Moreover, for instance in a "skin-pass" type cage, the metal strap A passes through deflecting rolls 15 located quite close to the working rolls 1, 1' and which are mounted at the end of supporting devices 16 with variable space requirements for adjusting their position.

As shown in FIG. 6, the provisions according to the invention enable make it possible to equip such a "skin-pass" mill with two wiping tools 4, 4', each associated with a supporting frame 3, 3', itself mounted on a cradle 2, 2', and the assembly can be arranged so that each supporting frame 3, 3', can bring the wiping tool 4, 4' close to the corresponding roll 1, 1' while passing between the strap and the various mill devices, and then to return by sliding the frame 3, 3 to a maintenance position in which the wiping tool and its means of application are perfectly accessible without installation shutdown.

While a one-piece tool 4 extending over the whole length to be cleaned is preferred, the tool could also be divided into several sections distributed over the length of the roll and each associated with one or several supporting arms and application jacks.

Figure 7:
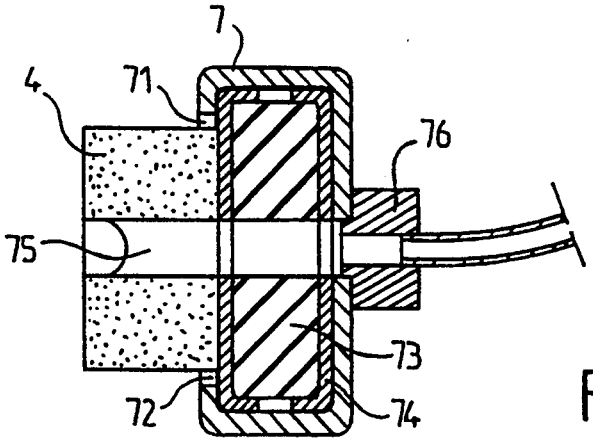
FIG. 7 shows a cross section of a particular embodiment of the cleaning tool.

Moreover, in order to render the pressing force of the wiping tool on the roll more homogeneous, the tool can be manufactured advantageously as shown in FIG. 7.

Usually, to prevent any markings on the roll, the wiping tool 4 is constituted of a special stone or a block of resin attached on a support.

In the embodiment shown in FIG. 7, the tool 4, which is constituted of a stone or a resin in the form of a ruler whose length is substantially equal to that of the roll, is connected to the supporting arm 46 via a girder 7 of rectangular section, having on one of its lateral surfaces, a slot 71 into which the tool 4 passes.

This tool is glued or attached in another way on a sheet 72 nested inside the box 7 and fixed, itself, in any way, on an elongated piece 73 in a flexible material fitted, on its opposite surface, with a second sheet 74. The entire flexible piece 73 and its two sheets 72, 74 have a total thickness slightly greater than that of the internal space delimited by the box 7 to enable insertion and retention inside the box. To this end, the box 7 is open at one end and closed at the other, the open end being fitted with a removable lock to ensure blockage of the tool.

The flexibility of the center part 73 of the tool retention piece allows greater homogeneity of application of the tool and adaptation to the geometry of the roll being cleaned.

According to another improvement, it is possible to adapt to the wiping tool various means for evacuating the particles that may be stuck on the roll surface, in order to avoid their getting encrusted.

For instance, the tool 4 can be drilled with a number of openings 75 distributed over its entire length and passing through the support 72, 73, 74 to lead into a manifold 76 to which a pressurized fluid intake duct is connected to clean the roll 1, this fluid being injected through the various openings 75 over the entire length of the tool.

Figure 8:
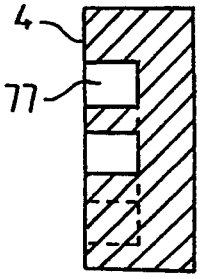
FIGS. 8 find 9 are, respectively, cross-section and front views of a particular embodiment of the wiping tool enabling collection of the dust particles.
Figure 9:
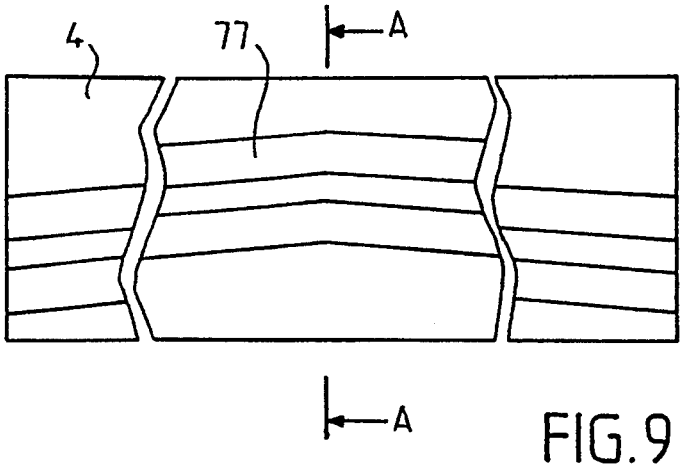

In order to collect the dust and the particles removed from the roll by the tool or resulting from its wear, one or more longitudinal grooves 77 can be provided on the contact surface of the stone 4 constituting the wiping tool, as shown in FIGS. 8 and 9. The grooves 77 may be slightly tilted toward the ends of the tool in order to allow evacuation of the particles collected outside the roll.

Figure 10:
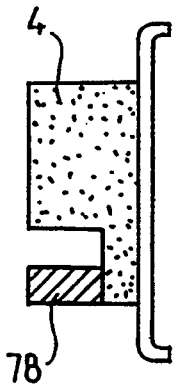
FIGS. 10 and 11 are cross-section views of embodiments of the tool.
Figure 11:
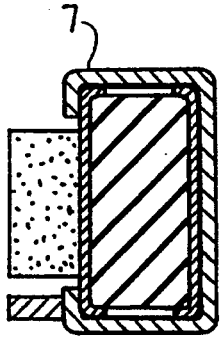

Collection of the particles can also be performed by a flexible blade 78 associated with the tool and made of rubber, plastic, felt or other material. This flexible blade is located along the stone 4 upstream, in the rotation direction of the roll and, thanks to its flexibility, allows the passage of particles which must be separated by the tool 4 while retaining them so that they do not fall back onto the strap. The flexible blade 78 can be attached to the stone 4, on the sheet 72 or directly on the box, as shown by way of example in FIGS. 10 and 11. Several blades 78, slightly spaced from each other, can be used, and they can be tilted to allow evacuation of the dust, as in the case of the slots in FIG. 9.

Other collection devices may also be used. For example, in the embodiment of FIG. 12, the external arms 45*a* for supporting the suspension pieces 46 accommodate a rigid plate 48 fitted on a lateral edge with a flexible blade 78' in contact with the roll to be wiped. In this case, the particles separated from the roll by the tool 4 are collected in the angle formed by the flexible blade 78 and the sheet 48, these two elements being slightly inclined toward at least one end of the roll in order to allow evacuation of the dust. This device can be dismantled quickly so that it can be changed at the same time as the tool.

Generally speaking, all the described devices can be used alone or in combination, the openings 75 in each case allowing a fluid to be distributed over the roll which facilitates evacuation of the particles, and the other devices enabling them to be collected and evacuated.

The invention has been described in the context of a rolling mill which constitutes its specific application because of the difficult access to the working rolls, especially in the case of the skin-pass mills and the necessity to perform maintenance and, possible, replacement of the cleaning tool without stopping the passage of the strap.

However, for the same reasons, the invention can be used in other units processing a metal straps or other materials by passage over rolls, and in which the space for locating the cleaning apparatus is restricted.

This is the case, for instance, of the tension blocks or tension bridle which may be located for instance, on both sides of a mill, in a cold mill cage or skin-pass, or in a planing installation.

Figure 13:
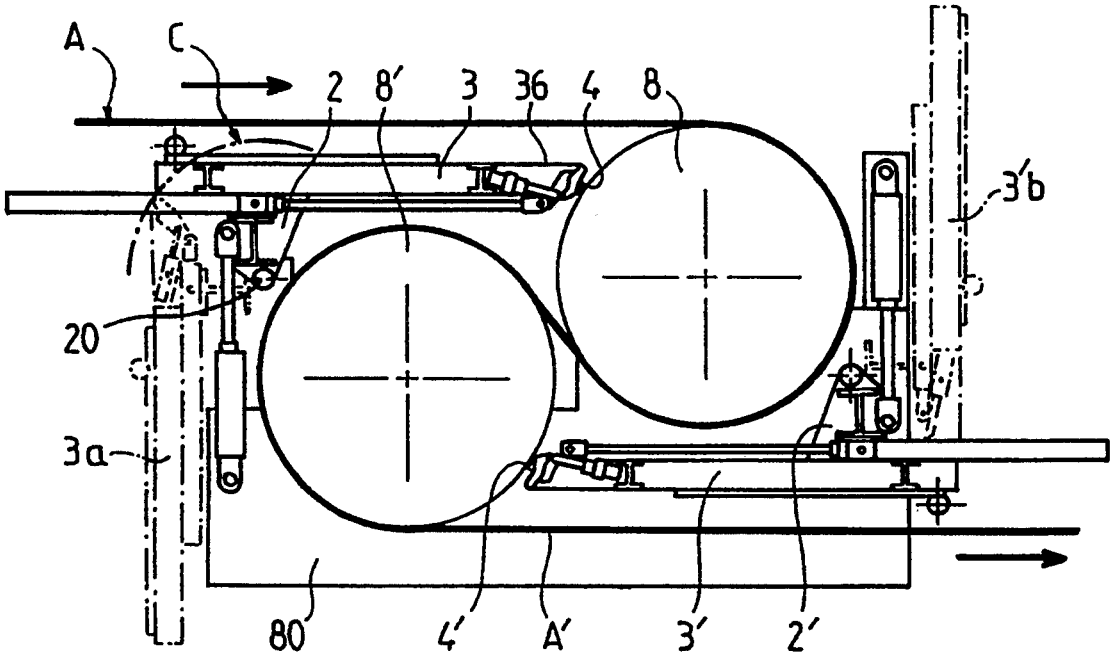
FIG. 13 is a schematic view of another application of the invention in a strap tension block.

Such a tension block, shown schematically in FIG. 13, usually comprises two rolls 8, 8', rotary-mounted in a chassis 80 and in which the metal strap A winds in an "S"-shaped path.

Here again, it is desirable to wipe the rolls without stopping the passage of the strap A. However, if, for instance, the first roll 8 is to be cleaned in the direction of passage of the strap A, which moves generally in a horizontal plane, tangentially to the roll 8, the shallow space available is particularly limited between the strap A and the periphery of the other roll 8', which is offset upstream with respect to the roll 8, i.e., on the same side as the strap A, in order to realize the desired "S"-shaped path.

The apparatus according to the invention is especially well suited to this application.

The pivoting axis 20 of the cradle 2 can be positioned so that, in working position, the sliding plane of the frame 3 is parallel to the strap A, which allows the frame 3 to move forward between the strap A and the roll 8' to the forward application position of the tool 4 on the roll 8.

To return to the maintenance position represented in dash-dot lines, the frame 3 is moved backward until its front end 36 reaches the front section of the cradle 2, the profile of the flanges 21 being so defined that, in this position, the front section 36 of frame 3 is located close to the plane passing by the pivoting axis 20 perpendicular to the strap A, i.e., in practice substantially vertically with respect to the axis 20. During toggling of the cradle 2, the front end of the frame 3 describes an arc of circle C coming close enough to the strap A, and passes at a sufficient distance from the strap to avoid any risks of interference.

It should be noted that, to the rear, the space is clear enough to allow rotation of the frame 3 in backward position to the maintenance position represented in dash-dot lines, and in which the frame 3*a* is oriented vertically along the corresponding surface of the chassis 80, whereas the tool 4 is sufficiently away from the strap A to allow its maintenance or its replacement.

Figure 12:
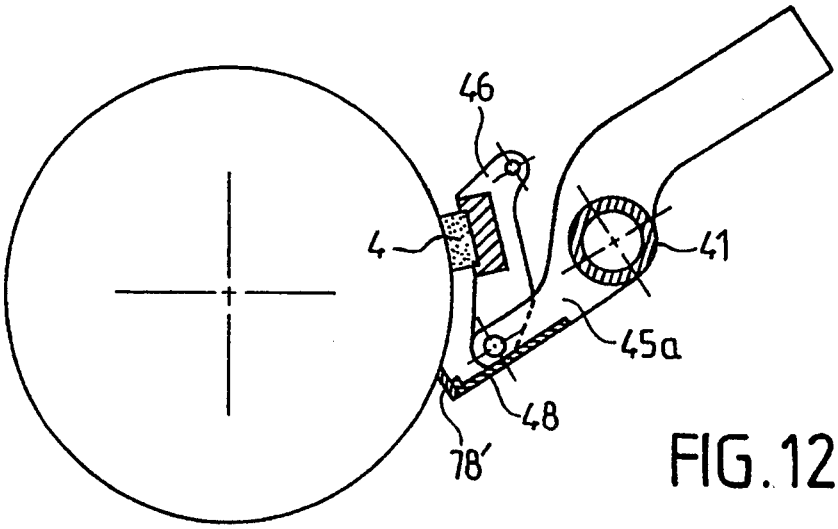
FIG. 12 is a schematic view of a wiping tool and of its means of application, fitted with a facility for collection of the dust particles.

As shown in FIG. 12, a second apparatus 3' can be positioned in a similar manner to clean the roll 8, the frame 3' passing horizontally between the roll 8 and the section A' of the strap leaving the roll 8', to apply the tool 4' on the area of the roll 8' which is not covered by the strap. The frame 3' can be brought back to its vertical maintenance position 3'*b*, its rear section projects upward with respect to the level of the roll 8.

Obviously, all the provisions described previously, especially for locking the frame 3 position, can be used in this application.

We claim:

1. Cleaning and polishing apparatus for rolls in contact with a metal strap moving in a longitudinal direction in an installation comprising a set of superposed rolls with parallel axes, rotary-mounted, each on two bearings carried by two vertical stands of a fixed supporting cage located on both sides of said rolls, said apparatus comprising:

(a) at least one wiping tool extending parallel to said axes of said rolls;

(b) a device supporting said at least one wiping tool, said device being mounted for sliding movement between a forward position and a backward position on straight guiding means provided on a cradle and defining an average sliding plane of said supporting device parallel to said axes of said rolls, said supporting device consisting of a rigid rectangular frame having a longitudinal length greater than a length of said sliding guiding means so that, in said working position of said cradle, said frame extends to a cantilevered forward position, beyond said guiding means, until a front section of said frame carrying said wiping tool is located close to said roll, and said front section is returned to a level of said cradle in said backward position of said frame in order to allow said cradle to pivot to said maintenance position along said stands of said cage;

(c) said cradle being mounted on both said stands of said cage for pivoting movement around a pivoting axis parallel to said axis of said rolls, said cradle comprising two parallel spaced flanges rigidly linked by a crossbeam;

(d) each of said flanges comprising two sections extending on both sides of said crossbeam, namely, an external widened section oriented to said strap and on which are provided said corresponding straight guiding means and an internal section oriented to said cage and on which is fixed a journal defining said pivoting axis;

(e) said journals being rotary-mounted, respectively on two bearings fixed, respectively, on both stands of said cage and located so that said cradle may pivot between a working position in which the sliding plane of said supporting device is oriented to said roll to be cleaned and a maintenance position in which said sliding plane is removed from the roll and the supporting device is located along both stands of said cage, slightly outside said cage;

(f) sliding means for control of said supporting device between a forward application position of said tool on said roll and a backward position; and, (g) control means for said cradle pivoting around said pivoting axis, between said maintenance position and said working position;

(h) said wiping tool being mounted for movement parallel to itself on said front section of the supporting device via an articulated control means to move said tool forward outside said supporting device to apply it on said roll, and to retract said tool backward out of contact with said roll.

2. Cleaning apparatus according to claim 1, wherein said articulated control means comprises at least two articulated arms at one extremity, on a free end of said supporting device, around an axis parallel to said rolls axes and carrying said wiping tool at the other end, and at least one control means for rotation of said arms about said axis for respective application and retraction of said tool.

3. Cleaning apparatus according to claim 1, wherein said supporting device consists of a rectangular metal frame delimited by two perpendicular longitudinal sides and with a thickness sufficient to ensure rigidity of said frame, but small enough to allow said frame to slide to said roll without interfering with said rolls and ancillary devices of said installation.

4. Cleaning apparatus according to claim 3, wherein, in the retraction position of said tool, said tool and said application means are folded back completely inside said supporting device.

5. Cleaning apparatus according to claim 3, wherein each of said longitudinal sides of said rectangular frame consists of a guiding profile sliding over at least two spaced rollers mounted for rotation on each of said flanges and constituting the guiding means of said frame, said rollers being spaced by a distance sufficient to ensure retention of the frame in its cantilevered forward position.

6. Cleaning apparatus according to claim 5, wherein each said guiding profile comprises two parallel wings on which said rollers bear.

7. Cleaning apparatus according to claim 1, wherein said means for controlling sliding of said supporting device are constituted by two jacks, each bearing one of said flanges and on a corresponding side of said supporting device, said jacks being associated with mechanical synchronization means to move forward both sides of said frame to maintain said tool parallel to said roll at all times.

8. Cleaning apparatus according to claim 1, wherein said supporting device is associated with removable means for rigid locking of at least said front section on both stands of said cage when in forward position.

9. Cleaning apparatus according to claim 8, wherein said removable locking means of said supporting device comprise at least a pair of blocking jacks located on both sides of said supporting device and each mounted on a part attached on a corresponding stand of said cage, in an area occupied by said front section of said supporting device when said supporting device is in forward position and extending and projecting to an inside of said cage in order to be in the way of a corresponding side of said supporting device, wherein each said cylinder located on said projecting part engages, when said supporting device slides between two spaced sections of said side and bears, in opposite directions, on said spaced sections to block said supporting device in forward position.

10. Cleaning apparatus according to claim 9, wherein each longitudinal side of said supporting device is constituted by a girder comprising two parallel wings, said projecting parts to support said locking jacks engaging respectively between said wings of a corresponding girder, each projecting part and associated jack abutting in opposite directions on both wings around said jack to block said supporting device.

11. Cleaning apparatus according to claim 1, wherein said supporting device is associated with a pair of jacks, each mounted on a projecting part attached on corresponding sides of said cradle between said rollers and bearing on the sides of said supporting device to apply them on said rollers while avoiding vibrations.

12. Cleaning device according to claim 1, wherein said wiping tool consists of at least one ruler-shaped profiled section parallel to said roll and substantially extending over the entire length of said roll, said ruler being carried by at least one supporting piece slidingly mounted on a stem parallel to the axis of said roll between two longitudinally offset positions, said supporting device being fitted with alternate control means to slide said supporting piece with said tool between said offset positions, so that said tool covers at least the entire length of said roll.

13. Cleaning apparatus according to claim 2, wherein said supporting piece of said wiping tool is attached on a sleeve engaged on a stem extending parallel to the roll axis between two ends attached on both sides of said supporting device, said sleeve being shorter than said roll by a given distance and being fitted at each end with a plate bearing on the corresponding side of the supporting device by a sliding link enabling alternate displacement of said sleeve over said given distance.

14. Cleaning device according to claim 2, wherein said supporting piece of said tool and of its control system consists of at least two spaced articulated levers on the free end of said supporting device around an axis parallel to the axis of said roll and extending on both sides of said articulation axis, between a first end on which the articulation axis of the rotary arms is mounted and a second means on which the application means of said tool bears in an articulated manner.

15. Cleaning apparatus according to claim 1, wherein said tool is made of a sole ruler substantially extending over the entire length of said roll.

16. Cleaning apparatus according to claim 1, wherein said tool is constituted by a plurality of sections arranged in sequence so as to cover substantially the entire length of said roll, each of said sections being carried by a supporting piece.

17. Cleaning apparatus according to claim 16, wherein each section of the wiping tool is constituted by a contact piece in the shape of a relatively tough ruler, attached over its entire length on a flexible elongated piece engaged in a hollow and rigid profile for maintaining said tool, said profile being attached to at least one supporting piece.

18. Cleaning apparatus according to claim 17, wherein said elongated piece is inserted between two spaced and parallel metal blades, respectively a rear blade and a front blade to which said contact piece is attached, the assembly formed by said flexible elongated piece associated with said metal blades being engaged in said hollow retaining profile.

19. Cleaning apparatus according to one claim 1, wherein said wiping tool is provided, on its surface contacting said roll, with at least one longitudinal groove extending over the entire length of said tool, and slightly ll, for recovery and evacuation of particles removed from said roll.

20. Cleaning apparatus according to claim 1, wherein said wiping tool is associated with a flexible blade extending over the entire length of the tool at some distance from said tool and upstream in the rotation direction of said roll, and bearing on said roll in order to retain particles removed from said roll by said tool, said flexible blade being slightly tilted with respect to the horizontal plane, at least to an end of said roll, to allow evacuation of the removed particles.

21. Cleaning apparatus according to claim 1, wherein said wiping tool is drilled with a plurality of bores distributed over its entire length and debouching on one side on the contact surface with said roll and on the other side into a manifold fed with pressurized fluid.

22. Cleaning apparatus according to claim 1, for use in cleaning a working roll in a mill comprising at least one working roll between at least two backing rolls superposed within a cage, wherein said cradle is sized and its pivoting axis positioned so that, in maintenance position, said front section of said frame carrying said tool is located substantially at the level of a center section of the backing roll corresponding to the working roll to be cleaned.

23. Cleaning apparatus according to claim 22, wherein, in working position, said cradle is located so that, in forward position, the surface of said frame supporting said tool oriented to said backing roll associated with said working roll to be cleaned passes close to the surface of said backing roll.

24. Cleaning apparatus according to claim 22, wherein said mill is a skin-pass rolling mill comprising at least one antipleating roll mounted on an adjustment device, and said cradle is oriented, in its working position, so that said supporting device passes in an inclined direction between said adjustment device and said backing roll associated with said roll to be cleaned.

25. Cleaning apparatus according to one of the claim 1, for use in cleaning a tension roll in a bridle block comprising at least first and second rolls mounted in a chassis and having axes offset in order to define an S-shaped path of a metal strap winding successively and directions around said first roll, then around said second roll, wherein, to clean said first roll, the pivoting axis of said cradle is located close to said second roll and on the other side of said first roll to be cleaned, and so that, in working position, the sliding plane of said frame is substantially parallel to the section of said metal strap winding around said first roll to be cleaned, said frame thus passing between said section of said strap and said second roll, while the front section of said frame comes, in its rearward position, close to the plane passing by said pivoting axis and perpendicular to said strap in order to clear said strap sufficiently while said apparatus is pivoting into its maintenance position.

* * * * *

UNITED STATES PATENT AND TRADEMARK OFFICE

CERTIFICATE OF CORRECTION

PATENT NO. : 5,383,306

DATED : January 24, 1995

INVENTOR(S) : Michalon et al

It is certified that error appears in the above-indentified patent and that said Letters Patent is hereby corrected as shown below:

In column 16, claim 19, line 9, delete "11" in favor of --tilted with respect to the horizontal plane, at least to an end of said roll--.

Signed and Sealed this

Twenty-third Day of May, 1995

*Attest:*

*Attesting Officer*

BRUCE LEHMAN

*Commissioner of Patents and Trademarks*